US009505116B2

(12) United States Patent
Wong

(10) Patent No.: US 9,505,116 B2
(45) Date of Patent: Nov. 29, 2016

(54) OVERRIDE MECHANISM FOR NAILERS

(71) Applicant: Raymond JL Wong, Los Angeles, CA (US)

(72) Inventor: Raymond JL Wong, Los Angeles, CA (US)

( * ) Notice: Subject to any disclaimer, the term of this patent is extended or adjusted under 35 U.S.C. 154(b) by 13 days.

(21) Appl. No.: 14/064,924

(22) Filed: Oct. 28, 2013

(65) Prior Publication Data

US 2015/0246437 A1 Sep. 3, 2015

(51) Int. Cl.
*B25C 1/00* (2006.01)
*B25C 5/16* (2006.01)

(52) U.S. Cl.
CPC ..... *B25C 1/001* (2013.01); *B25C 5/1689* (2013.01)

(58) Field of Classification Search
CPC ..... B25C 1/005; B25C 1/001; B25C 5/1658
USPC ..... 227/8, 109, 119, 120, 130, 127, 136, 227/156
See application file for complete search history.

(56) References Cited

U.S. PATENT DOCUMENTS 3,741,455 A * 6/1973 Wandel ..... B25C 1/006 227/120
3,809,307 A * 5/1974 Wandel ..... B25C 1/008 227/8
6,056,181 A * 5/2000 Chuang ..... B25C 5/161 227/120
6,966,477 B1 * 11/2005 Chien-Kuo ..... B25C 1/005 227/120

* cited by examiner

*Primary Examiner* — Nathaniel Chukwurah

(57) ABSTRACT

An override mechanism for a nailer includes a nose unit, a magazine, a safety bar, a lever, a pivotal plate and a restriction member. The safety bar has one side slidably engaged with the guide slot of the nose unit. The lever has an extension and a pressing portion on two ends thereof. The pivotal plate has a base portion and an operation end, and the pivotal plate is pivotable relative to the extension of the lever. The operation end extends through the magazine and enters one of the grooves in the magazine. The operation end is located on the movement track of the side plate of the push plate. The restriction member is movably located in the longitudinal hole of the base. The user is acknowledged when a pre-set number of nails is remained in the magazine by restricting movement of the safety bar.

5 Claims, 5 Drawing Sheets

OVERRIDE MECHANISM FOR NAILERS

FIELD OF THE INVENTION

The present invention relates to a nailer, and more particularly, to an override mechanism of a nailer.

BACKGROUND OF THE INVENTION

The conventional nailer generally comprises a magazine which receives nails therein and a push plate is biased by a spring so as to push the nails toward the path in the body of the nailer such that the nails are shot one by one. However, the user cannot be acknowledged the number of the remained nails in the magazine.

When working to the ceiling, the user usually stands on a ladder, and one hand supports or touches the ceiling and the other hand operates the nailer. Because the user cannot check the number of the nails in the magazine, so that the user usually shoots the nails until all of the nails are shot. A new set of nails is then installed in the magazine to continue the work. In some situations, such as when the user shifts the ladder and starts to nail the ceiling, only three nails are left in the magazine so that after the three nails are shot, the ceiling still in unstable status but the user cannot remove his/her hand to reload the nails. This causes time delay and needs other people to help for securing the unstable ceiling.

The present invention intends to provide a nailer which allows the user to check the remained nails in the magazine and has an option to shoot all of the nails in the magazine.

SUMMARY OF THE INVENTION

The present invention relates to an override mechanism for a nailer and comprises a nose unit having an end board and an end plate connected to the end board. The end board has a nail path defined longitudinally therethrough and communicating with multiple entrances in the rear side of the end board. A guide slot is defined in the rear side of the end board and located on one side of the entrances. A magazine is composed of a base and a cover mounted to the base. The base has multiple grooves and a push plate is slidably engaged with one of the grooves by its side plate. An elongate hole is defined in the outside of the base and communicates with the grooves. A longitudinal hole is defined in a front end of the base. A safety bar has one side slidably engaged with the guide slot of the end board. A notch is defined in the safety bar. A lever has two fulcrums on two sides of its middle portion thereof and the lever is pivotable relative to the base of the magazine. The lever has an extension extending from one end thereof, and a pressing portion is formed on the other end of the lever. A spring is biased between the pressing portion and the base. A pivotal plate has a base portion and an operation end, wherein the base portion is fixed to the extension by a pin so that the pivotal plate is pivotable relative to the extension. The operation end extends through the elongate hole and enters one of the grooves. The operation end is located on the movement track of the side plate of the push plate. A restriction member is movably located in the longitudinal hole of the base and has an engaging portion on one end thereof. A spring is located in the longitudinal hole of the base. The operation end of the pivotal plate is pivoted horizontally by the side plate of the push plate to control the engaging portion of the restriction member to be moved into the notch of the safety bar, so that the safety bar is controlled to be moved up and down. By this way, the user is acknowledged that a pre-set number of nails is remained in the magazine.

The extension of the lever is removed from outside of the base by pressing the pressing portion of the lever again until the operation end of the pivotal plate is completely removed from the movement track of the side plate of the push plate, such that the pivotal plate pushes all of the remained nails in the magazine toward the nail path of the nose unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
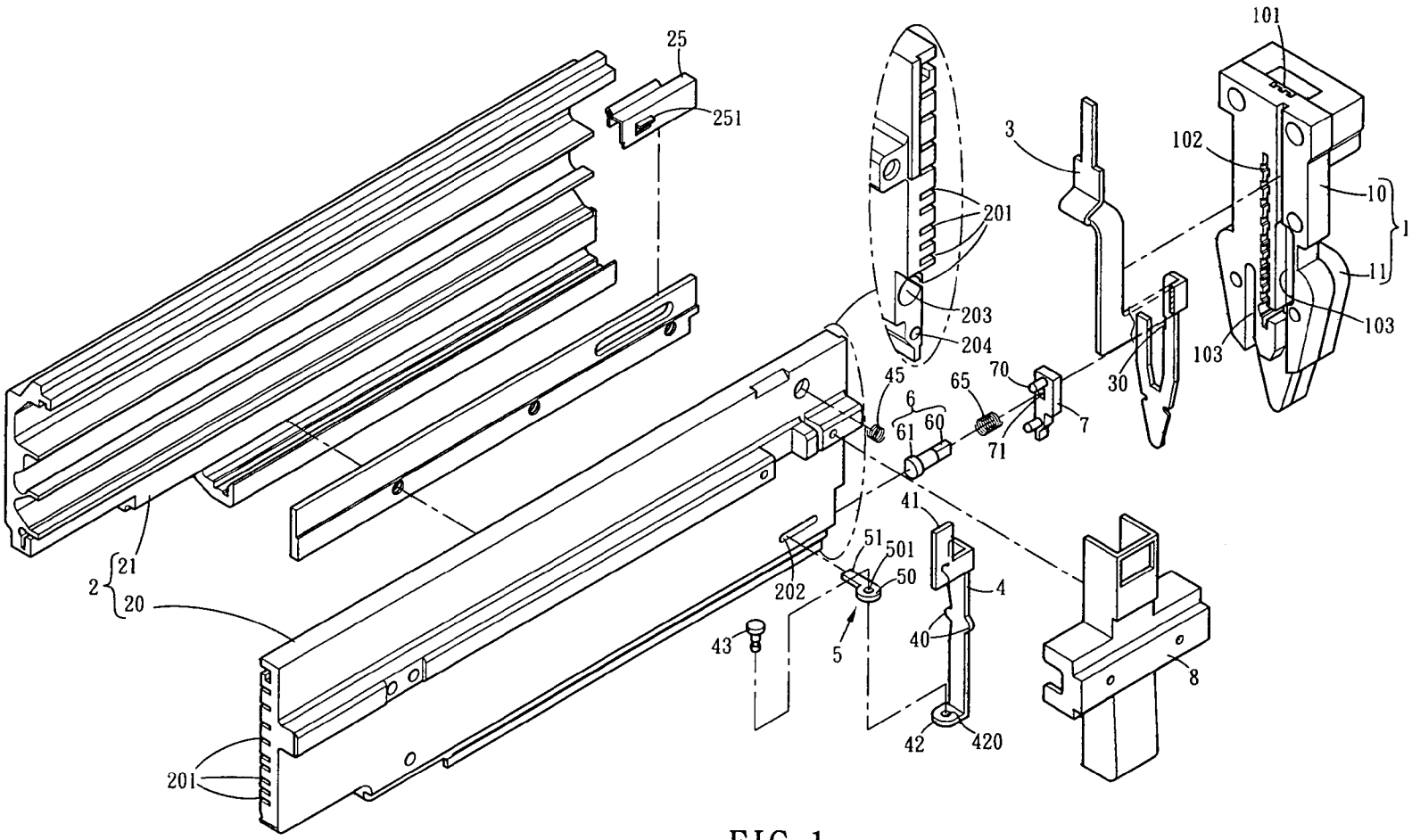
FIG. 1 is an exploded view to show the override mechanism of a nailer of the present invention.

Referring to FIGS. 1 to 5, the override mechanism of a nailer of the present invention comprises a nose unit 1 having an end board 10 and an end plate 11 which is connected to the end board 10. The end board 10 has a nail path 101 defined longitudinally therethrough. Multiple entrances 102 are defined in the rear side of the end board 10 and communicate with the nail path 101. A guide slot 103 is defined in the rear side of the end board 10 and located on one side of the entrances 102.

A magazine 2 has a base 20 and a cover 21 which is mounted to the base 20. The base 20 has multiple grooves 201 defined in the inside thereof. A push plate 25 has a side plate 251 extending from one side thereof and the side plate 251 is slidably engaged with one of the grooves 201. An elongate hole 202 is defined in the outside of the base 20 and communicates with the grooves 201. A longitudinal hole 203 and a positioning hole 204 are defined in the front end of the base 20.

A safety bar 3 has one side slidably engaged with the guide slot 103 of the end board 10. The movement track is parallel to the nail path 101 of the end board 10. A notch 30 is defined in the safety bar 3.

Figure 2:
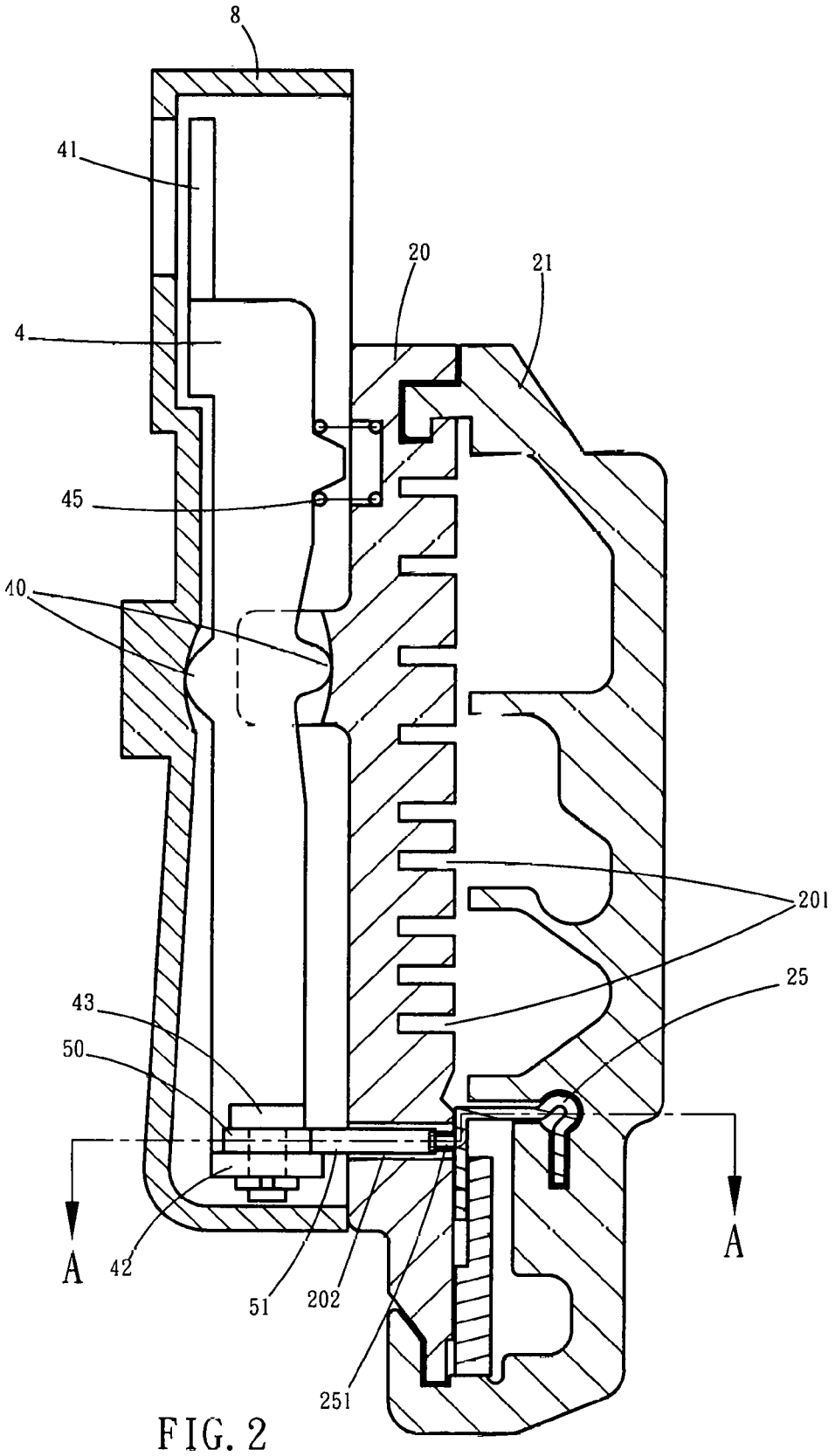
FIG. 2 is an end cross sectional view to show the override mechanism of a nailer of the present invention.
Figure 3:
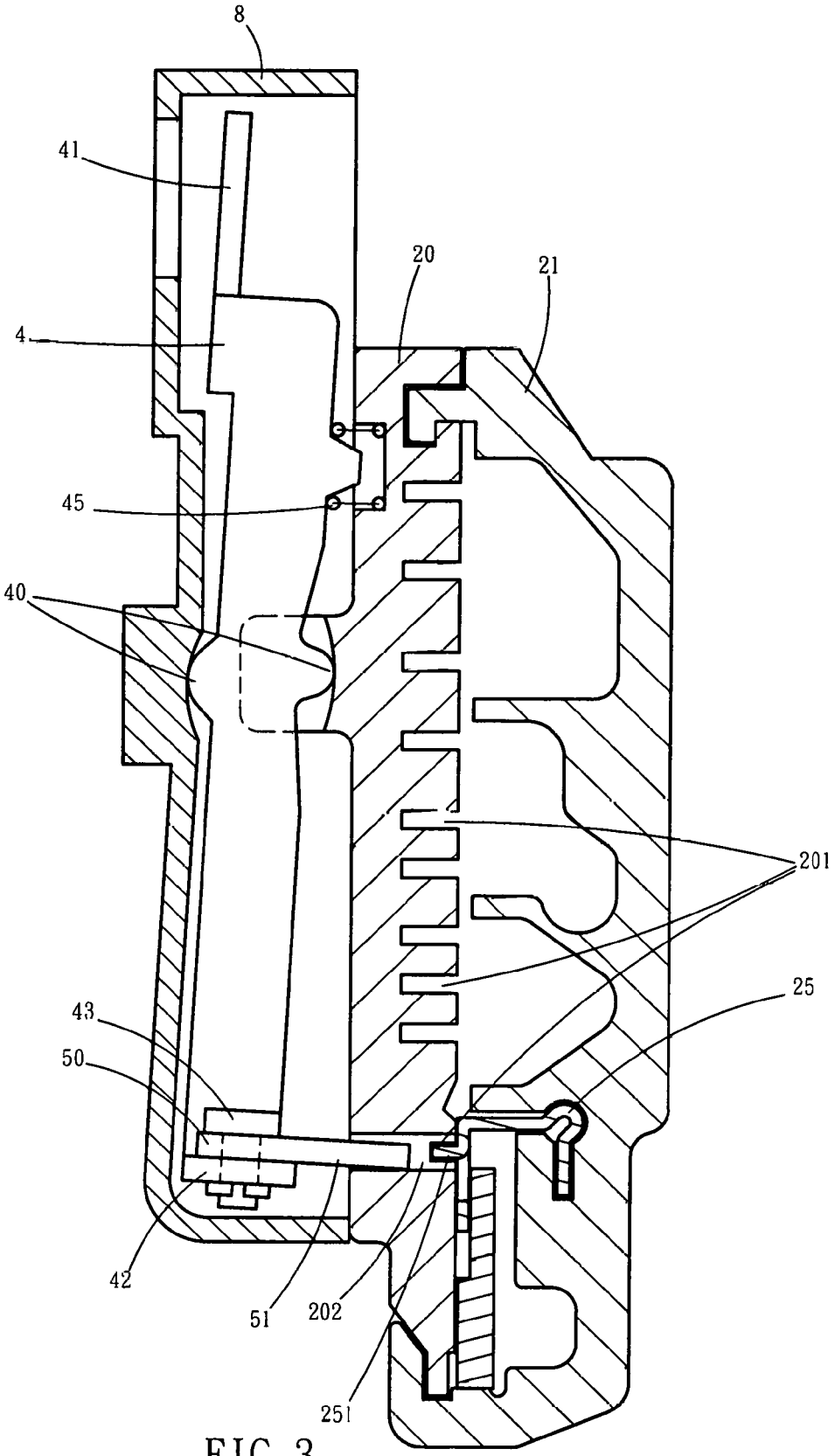
FIG. 3 is an end cross sectional view to show that the lever and the pivotal plate of the override mechanism are pivoted.

A lever 4 has a fulcrum 40 on two sides of the middle portion thereof, the fulcrum includes two protrusions on two sides of the lever 4. The lever 4 is connected to the magazine 20 by a fixing part 8 so that the lever 4 is pivotable relative to the base 20 of the magazine 30. It is noted that the fixing part 8 and the base 20 each have a curved recess so that the two protrusions of the fulcrum 40 of the lever 40 are engaged with the two curved recesses as shown in FIGS. 2 and 3. The lever 4 has an extension 42 extending from one end thereof and the extension 42 of the lever 4 has an aperture 420. A pressing portion 41 is formed on the other end of the lever 4. A spring 45 is biased between the pressing portion 41 and the base 20.

A pivotal plate 5 has a base portion 50 and an operation end 51, wherein the base portion 50 of the pivotal plate 5 has a through hole 501. A pin 43 extends through the aperture 420 and the through hole 501 to connect the lever 4 and the push plate 5. The pivotal plate 5 is pivotal horizontally relative to the extension 42 of the lever 4. The operation end 51 extends through the elongate hole 202 and enters one of the grooves 201. The operation end 51 is located on the movement track of the side plate 251 of the push plate 25.

A restriction member 6 is movably located in the longitudinal hole 203 of the base 20 and has an engaging portion 60 on one end thereof. The restriction member 6 has a shank 61 located opposite to the engaging portion 60. A spring 65 is located in the longitudinal hole 203 of the base 20 and has one end thereof contacts the shank 61.

Figure 4:
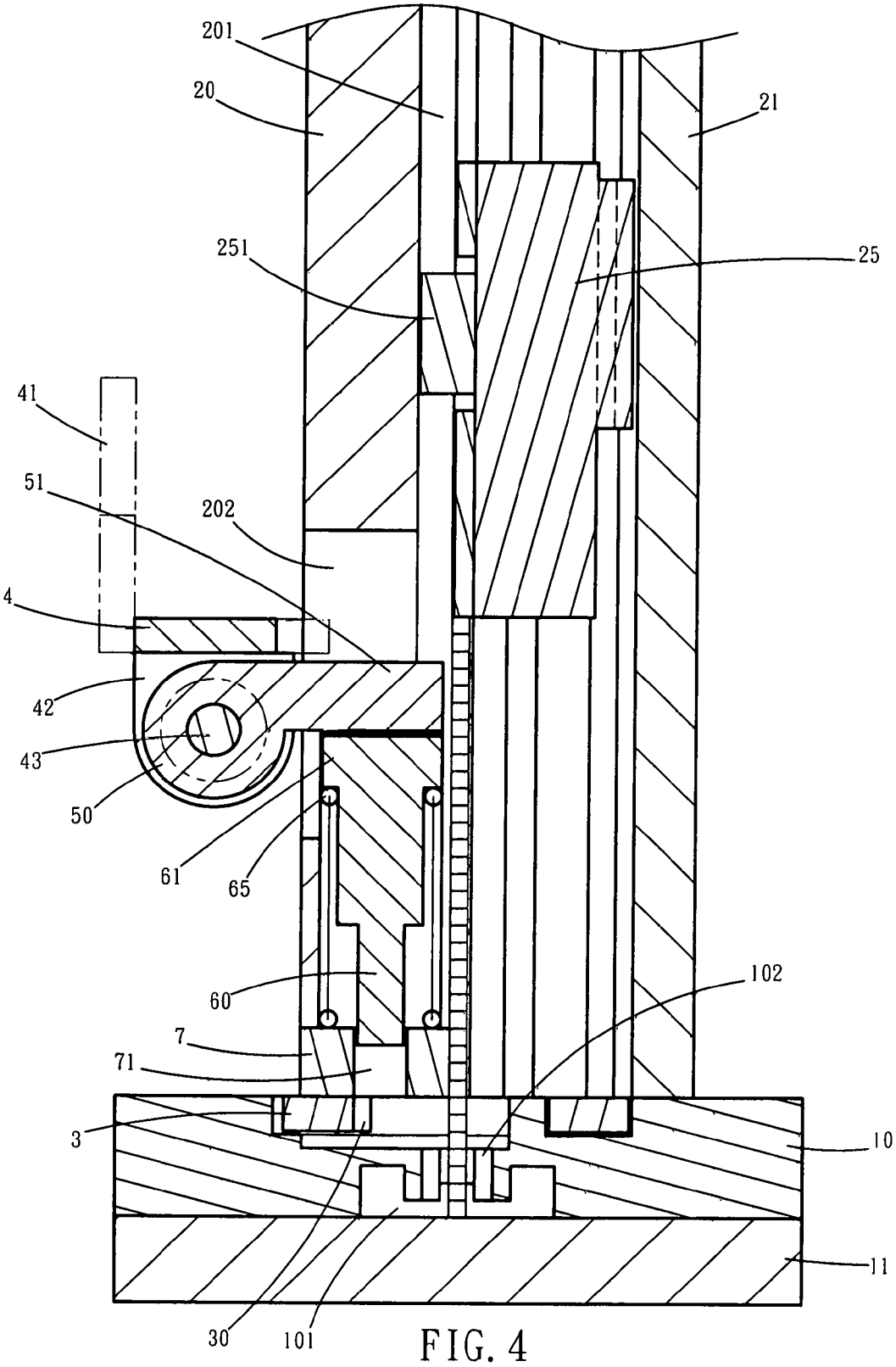
FIG. 4 shows another cross sectional view of FIG. 2.
Figure 5:
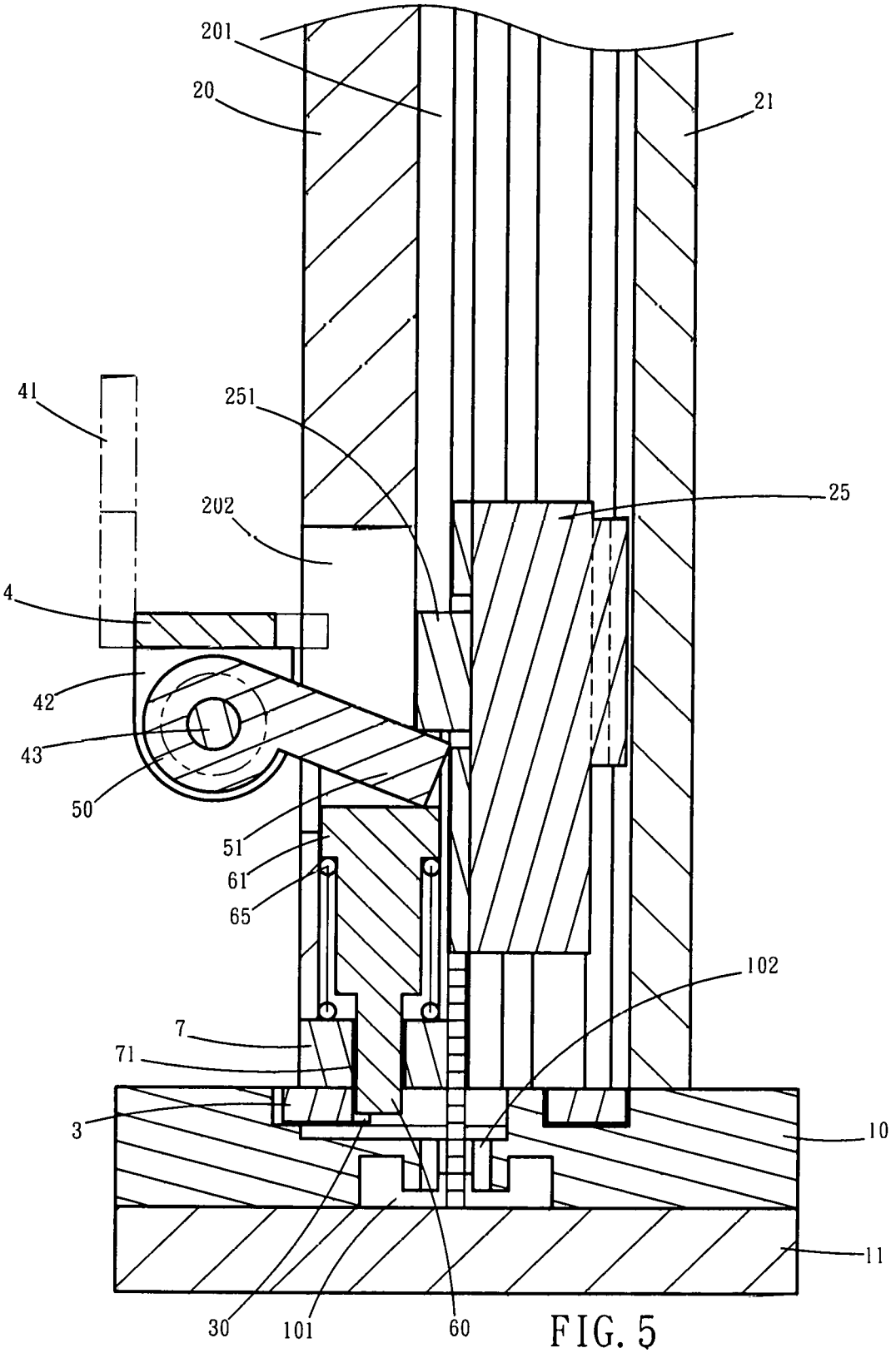
FIG. 5 is a cross sectional view to show that the pivotal plate of the override mechanism is pivoted.

A fixing member 7 has a protrusion 70 which is inserted into the positioning hole 204. The fixing member 7 has a rectangular hole 71 which is located in alignment with the longitudinal hole 203 so that the restriction member 6 and the spring 65 are restricted between the fixing member 7 and the inner end of the longitudinal hole 203 as shown in FIGS. 4 and 5.

When the number of the nails in the magazine 2 reaches the pre-set number of the nails, the side plate 251 of the push plate 25 pushes the operation end 51 of the pivotal plate 5 so that the operation end 51 is pivoted horizontally and pushes the restriction member 6 toward the safety bar 3 until the engaging portion 60 of the restriction member 6 is moved into the notch 30 of the safety bar 3. Therefore, the safety bar 3 cannot move up and down as shown in FIGS. 2 and 5. By this way, the user is acknowledged that only the pre-set amount of the nails is left in the magazine 2.

If the user decides to continue the nailing work, he or she simply presses the pressing portion 41 of the lever 4 as shown in FIG. 3, the lever 4 is pivoted about the fulcrum 40 relative to the base 20 of the magazine 2. The extension 42 of the lever 4 is then removed from outside of the base 20 until the operation end 51 of the pivotal plate 5 is completely removed from the movement track of the side plate 251 of the push plate 25, such that the push plate 25 push nails in the magazine 2 toward the nail path 101 of the nose unit 1 and ready for next shooting action.

Therefore, the user can decide the proper timing to reload the nails or to shoot the remained nails.

While we have shown and described the embodiment in accordance with the present invention, it should be clear to those skilled in the art that further embodiments may be made without departing from the scope of the present invention.

What is claimed is:

1. An override mechanism for a nailer, comprising:

a nose unit having an end board and an end plate connected to the end board, the end board having a nail path defined longitudinally therethrough, multiple entrances defined in a rear side of the end board and communicating with the nail path, a guide slot defined in the rear side of the end board and located on one side of the entrances;

a magazine having a base and a cover which is mounted to the base, the base having multiple grooves defined in an inside thereof, a push plate having a side plate extending from a side thereof and the side plate slidably engaged with one of the grooves, an elongate hole defined in an outside of the base and communicating with the grooves, a longitudinal hole defined in a front end of the base;

a safety bar having one side slidably engaged with the guide slot of the end board, a notch defined in the safety bar;

a lever having two fulcrums on two sides of a middle portion thereof, the lever being connected to the magazine by a fixing part so that the lever is pivotable relative to the base of the magazine, the lever having an extension extending from one end thereof, a pressing portion being formed on the other end of the lever, a spring being biased between the pressing portion and the base;

a pivotal plate having a base portion and an operation end, the base portion being connected to the extension by a pin so that the pivotal plate is pivotable relative to the extension, the operation end extending through the elongate hole and entering one of the grooves, the operation end located on a movement track of the side plate of the push plate;

a restriction member movably located in the longitudinal hole of the base and having an engaging portion on one end thereof, a spring located in the longitudinal hole of the base, and the operation end of the pivotal plate being pivoted horizontally by the side plate of the push plate to control the engaging portion of the restriction member to be moved into the notch of the safety bar so that the safety bar is controlled to be moved up and down, the extension of the lever being removed from outside of the base by pressing the pressing portion of the lever again until the operation end of the pivotal plate being completely removed from the movement track of the side plate of the push plate such that the push plate adapted to push nails in the magazine toward the nail path of the nose unit.

2. The override mechanism as claimed in claim 1, wherein the extension of the lever has an aperture and the base portion of the pivotal plate has a through hole, the pin extends through the aperture and the through hole to connect the lever and the push plate, the pivotal plate is pivotal horizontally relative to the lever.

3. The override mechanism as claimed in claim 2, wherein the restriction member has a shank located opposite to the engaging portion, the spring has one end thereof contacts the shank.

4. The override mechanism as claimed in claim 3, wherein the fixing part and the base each have a curved recess so that the two fulcrums of the lever are engaged with the two curved recesses.

5. The override mechanism as claimed in claim 4, wherein a positioning hole is defined in the front end of the base and a fixing member has a protrusion which is inserted into the positioning hole, the fixing member has a rectangular hole which is located in alignment with the longitudinal hole so that the restriction member and the spring are restricted between the fixing member and an inner end of the longitudinal hole.

* * * * *